US006918400B2

(12) United States Patent
Buchner et al.

(10) Patent No.: US 6,918,400 B2
(45) Date of Patent: Jul. 19, 2005

(54) MODULAR LAVATORY FAUCET SPOUT MOUNTING

(75) Inventors: Daniel C. Buchner, Amherst, OH (US); John H. Daniel, III, Strongsville, OH (US); Todd C. Loschelder, Macedonia, OH (US); Allen L. Talley, Hudson, OH (US); Timothy J. O'Brien, Bay Village, OH (US); William R. Markowitz, Cleveland, OH (US); Erwin F. Mikol, The Villages, FL (US)

(73) Assignee: Moen Incorporated, North Olmsted, OH (US)

( * ) Notice: Subject to any disclaimer, the term of this patent is extended or adjusted under 35 U.S.C. 154(b) by 0 days.

(21) Appl. No.: 10/026,210

(22) Filed: Dec. 19, 2001

(65) Prior Publication Data

US 2002/0053361 A1 May 9, 2002

Related U.S. Application Data

(63) Continuation of application No. 09/576,292, filed on May 23, 2000, now Pat. No. 6,360,770.

(51) Int. Cl.[7] ..... F16K 43/00; E03C 1/04

(52) U.S. Cl. ..... 137/15.01; 137/315.12; 137/359; 137/801; 4/678; 4/695

(58) Field of Search ..... 137/15.01, 15.08, 137/315.12, 359, 360, 801; 4/675, 676, 678, 695, 615; 285/333, 355, 390; 239/282

(56) References Cited

U.S. PATENT DOCUMENTS

| | | | | | |
|---|---|---|---|---|---|
| 1,592,353 | A | * | 7/1926 | Gade | 137/360 |
| 3,012,251 | A | * | 12/1961 | Fife | 137/359 |
| 3,136,570 | A | * | 6/1964 | Lee | 137/360 |
| 3,371,679 | A | * | 3/1968 | Minella | 137/359 |
| 3,443,266 | A | * | 5/1969 | Mongerson et al. | 137/359 |
| 3,609,774 | A | * | 10/1971 | Allgood | 137/359 |
| 3,640,305 | A | * | 2/1972 | Young | 137/360 |

(Continued)

*Primary Examiner*—Kevin Lee
(74) *Attorney, Agent, or Firm*—Calfee, Halter & Griswold LLP

(57) ABSTRACT

A faucet spout fixture provides for spout mounting and removal from above a supporting surface such as a sink deck, without disconnection of the water supply conduits beneath the sink deck. The fixture includes a faucet spout which has a water passage and a water discharge in communication with the passage. There is a water inlet in the spout which communicates with the passage. A water supply assembly is located beneath the supporting surface and there is a spout waterway adjustably connected to the water supply assembly, which spout waterway extends into the spout water inlet. There is a clamp member adjustably mounted on the spout waterway to be positioned against and on top of the supporting surface sink deck. A spout fastener extends through an opening in the clamp member and is held in position therein by a portion of the spout waterway. The spout fastener adjustably cooperates with a threaded bore on the spout to removably fasten the spout against and on top of the supporting surface.

7 Claims, 3 Drawing Sheets

U.S. PATENT DOCUMENTS 3,739,806 A * 6/1973 Bucknell et al. ..... 137/359
3,911,946 A * 10/1975 Humpert et al. ..... 137/359
4,387,738 A 6/1983 Bisonaya et al.
4,635,673 A 1/1987 Gerdes
4,678,002 A * 7/1987 Valley ..... 137/801
4,706,702 A * 11/1987 Grasseschi ..... 137/360
4,852,192 A 8/1989 Viegener
4,998,555 A 3/1991 Barhydt, Sr. et al.
5,010,922 A 4/1991 Agresta
5,131,428 A 7/1992 Bory
5,165,121 A 11/1992 McTargett et al.
5,224,509 A 7/1993 Tanaka et al.
5,232,008 A 8/1993 Jeffress et al.
5,275,199 A * 1/1994 Howell ..... 137/360
5,381,830 A 1/1995 Niemann et al.
5,388,287 A 2/1995 Tischler et al.
5,458,154 A 10/1995 Niemann et al.
5,464,045 A 11/1995 Niemann et al.
5,465,749 A 11/1995 Sauter et al.
5,515,882 A 5/1996 Hennis
5,558,128 A 9/1996 Pawelzik et al.
5,642,755 A 7/1997 Mark et al.
5,669,417 A 9/1997 Lian-Jie
5,685,341 A 11/1997 Chrysler et al.
5,746,244 A * 5/1998 Woolley, Sr. et al. ..... 137/359
5,797,151 A 8/1998 Ko
5,803,120 A 9/1998 Bertoli
5,813,431 A * 9/1998 Cool et al. ..... 137/801
5,865,211 A * 2/1999 Thomas ..... 137/359
5,979,489 A * 11/1999 Pitsch ..... 137/359
6,378,912 B1 * 4/2002 Condon et al. ..... 4/678

* cited by examiner

Fig. 2.
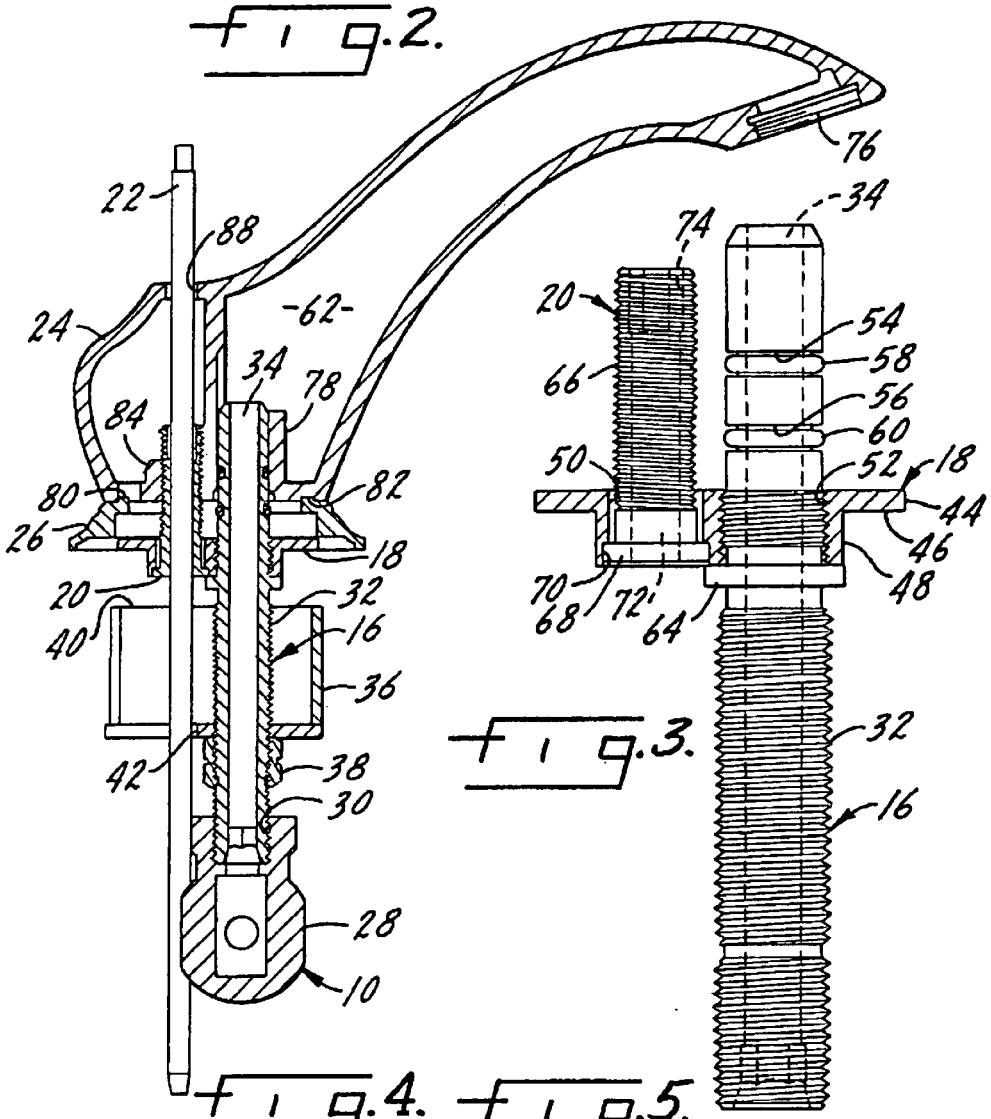
Fig. 3.
Fig. 4.
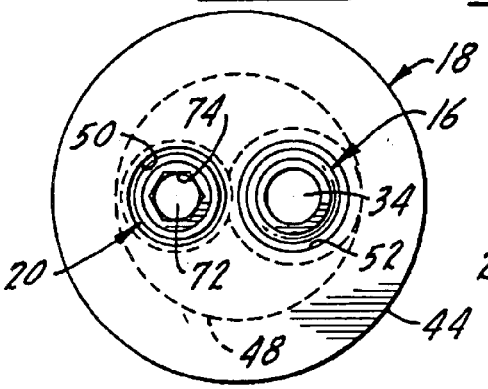
Fig. 5.
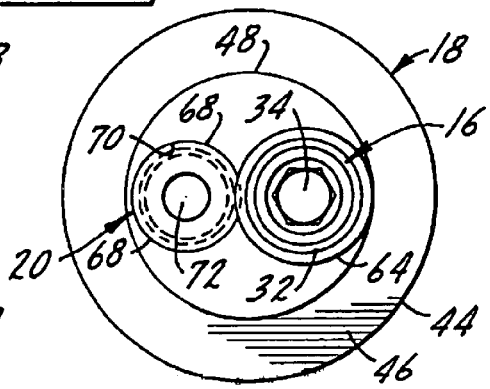

110
112
114
116
118
120
122
124
126
127
128
130
132
134
136
138
140
11

MODULAR LAVATORY FAUCET SPOUT MOUNTING

This application is a continuation of U.S. application Ser. No. 09/576,292, filed May 23, 2000, now U.S. Pat. No. 6,360,770, which is incorporated by reference herein.

THE FIELD OF THE INVENTION

The present invention relates to what is termed "modular" lavatory faucet spouts and in particular to a faucet spout fixture in which the spout may be removed from above the sink deck without affecting the waterway connections beneath the sink deck. This permits the decorative portion of the plumbing fixture—the spout—which also has a functional purpose, to be removed and replaced without affecting the plumbing connections. Such is particularly advantageous for consumers who are remodeling and wish to change a plumbing fixture, and to builders who are selling upgraded fixtures in new construction and wish to avoid the necessity of buying an entirely new plumbing fixture and the consequent installation expense.

With the present invention the spout or any similar water control plumbing fixture may have the exposed decorative and/or functional element thereof removed and replaced, with a similar element having a different appearance, but with the same function, without in any way requiring the underlying waterways to be disconnected. Although the invention will be described more particularly in connection with a lavatory faucet spout, it is equally applicable to any other water control plumbing fixture, or combination of a group or suite of such fixtures having a common decorative theme, in which there is a functional and decorative element on one side of a supporting, normally visible surface and the waterway connections are on the opposite or normally non-visible side of the supporting surface.

SUMMARY OF THE INVENTION

The present invention relates to modular plumbing fixtures and in particular to a faucet spout fixture in which the spout may be removed from the exposed side of the sink deck without affecting the underlying waterway connections.

A primary purpose of the invention is to provide a modular plumbing fixture for water control in which the decorative and exposed portion may be easily removed and replaced without affecting the underlying waterway connections.

Another purpose is to provide an improved, reliable and simplified mounting for a faucet spout in which all of the exposed elements of the spout may be removed from only the top side of the sink deck.

Other purposes will appear in the ensuing specification, drawings and claims.

BRIEF DESCRIPTION OF THE DRAWINGS

The invention is illustrated diagrammatically in the following drawings wherein:

FIG. 2 is an axial section through the plumbing fixture;

FIG. 3 is an enlarged, in part section, of the clamping portion of the plumbing fixture; and FIG. 4 is a top view of the clamp plate, spout waterway and spout screw;

FIG. 5 is a bottom view of the clamp plate, spout waterway and spout screw;

DESCRIPTION OF THE PREFERRED EMBODIMENT

Figures 1, 6, 7, 8:
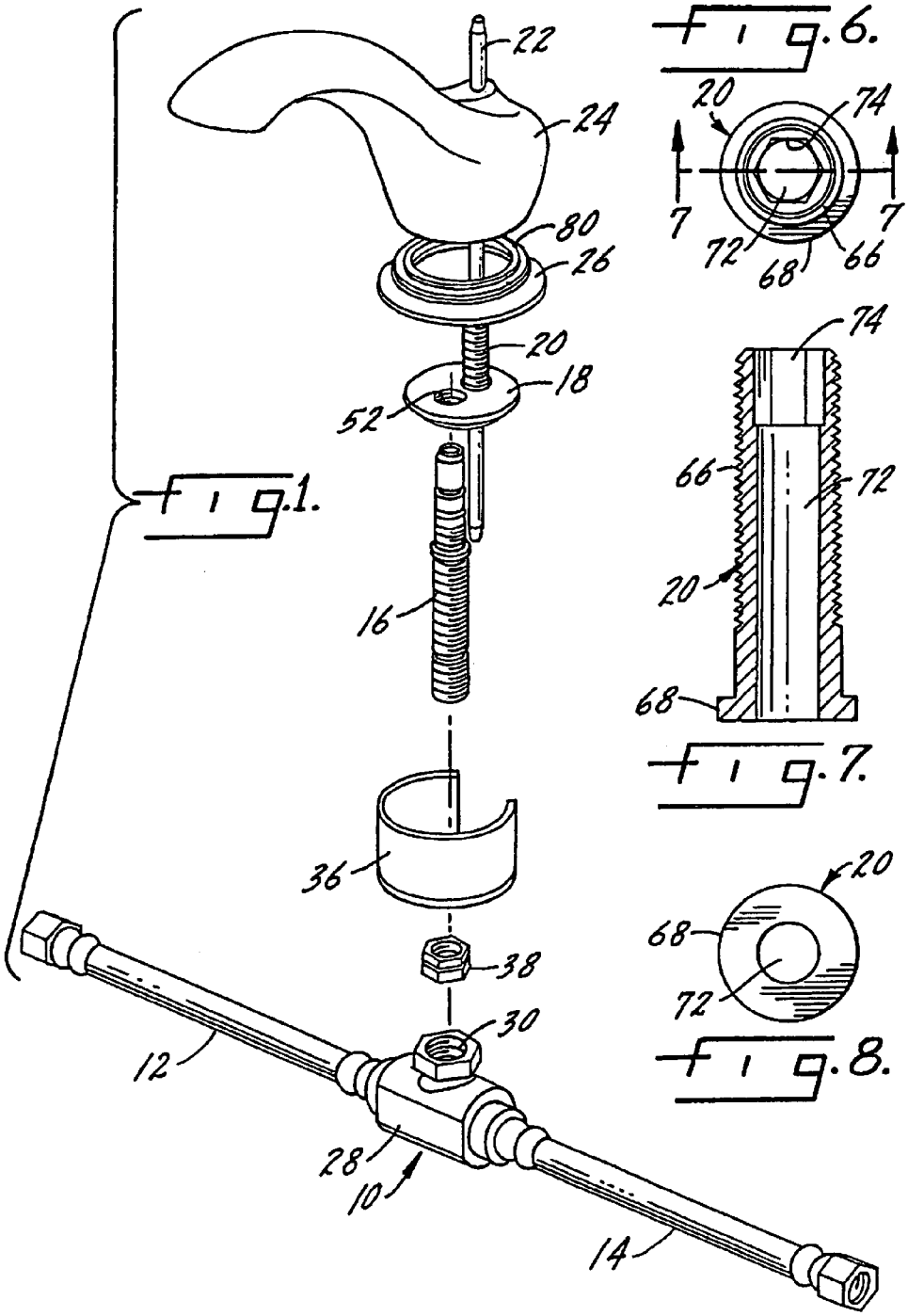
FIG. 1 is an exploded perspective of the plumbing fixture of the present invention.
FIG. 6 is an enlarged top view of the spout screw.
FIG. 7 is a section along plane 7—7 of FIG. 6.
FIG. 8 is a bottom view of the spout screw.

FIG. 1 illustrates the principal components of the faucet spout fixture. The fixture shown is a lavatory spout, although the invention is equally applicable to other types of water control plumbing fixtures which are mounted on a supporting surface such as a sink deck or wall.

The hose assembly is indicated at 10 and will have a hot water conduit 12 and a cold water conduit 14. There is a spout waterway 16 which will be connected, as described, to the hose assembly 10. A clamp member 18 threadedly mounts the spout waterway 16 and a fastener 20 will be held in the clamp member 18 by the spout waterway 16 and provides both a support for the lift rod 22 and the means for mounting the spout 24 and the escutcheon 26 to the sink deck.

As illustrated in FIG. 2, the hose assembly 10 has a central connector 28 with an upwardly-facing threaded bore 30. The spout waterway 16 which is exteriorly threaded, as at 32, will be threadedly mounted in the bore 30 and has an internal water passage 34 to direct water from the hose assembly 10 up to the spout 24. There is a partially cylindrical mounting washer 36 which is held in position on the waterway 16 by a mounting nut 38, with the top surface 40 of the mounting washer normally abutting the underside of the sink deck. The mounting washer 36 has an opening 42 for passage of the lift rod 22.

The clamp plate 18 has a plate portion 44, the lower surface 46 of which will normally be seated on the top of the sink deck. There is a cylindrical boss 48 which will extend downwardly through an opening in the sink deck and has a first opening 50 for the threaded fastener 20 and a second threaded opening 52 for threaded attachment of the spout waterway 16. This is particularly shown in FIG. 3. The spout waterway 16 has spaced grooves 54 and 56, each of which contains seal rings 58 and 60, respectively. The upper end of the spout waterway 16 extends into an interior water passage 62 of the spout 24, as shown in FIG. 2.

The spout waterway 16 has an outwardly extending annular shoulder 64 which will normally abut the underside of the boss 48, as shown in FIG. 3, when the waterway is mounted to the clamp plate 18. The spout fastener 20, which is threaded, as at 66, throughout substantially its entire length, has a head or flange 68 at its bottom side, which flange cooperates with the shoulder 64 on the spout waterway 16 to hold the fastener in position in the clamp plate. This is shown in FIG. 3. There is a small recess 70 at the bottom end of the opening 50 to accept the flange 68 of the fastener 20 so that the fastener may be somewhat loosely held in position, but there is no permitted degree of axial movement of the fastener once it is held in the clamp plate by the spout waterway.

The fastener is shown more particularly in FIGS. 6, 7 and 8 and has an internal bore 72 for passage of the lift rod 22 and has a tool receiving hex-shaped opening 74 at the upper end thereof. The tool receiving opening will be used, as described hereinafter, to attach and remove the spout to the clamp plate and thus to the sink deck.

The spout 24 has a discharge opening 76 which communicates with the passage 62 and the passage 62 is in communication with the upper end of the spout waterway 16. The spout 24 has a smooth cylindrical boss 78 which functions as the water inlet and the spout waterway extends into this boss with the seal rings bearing against its interior wall. The spout 24 is seated upon the escutcheon 26 and the escutcheon may have an upwardly raised bead 80 which extends within a groove 82 in the bottom of the spout interlocking these two elements. There is a threaded boss 84 in the spout, as particularly shown in FIG. 2, which will receive the threaded spout fastener 20. This is the means for attaching the spout to the fastener which is in turn attached to the clamp plate by the spout waterway.

To assemble the faucet spout fixture, first the hose assembly will be attached to the underside of a sink deck by use of the spout waterway and the clamp plate 18. The waterway will be threadedly attached, with the mounting washer 36 and the mounting nut 38, to the underside of the sink deck, with the clamp plate 18 on the top side of the sink deck. The hose assembly may be connected to the hot and cold water supplies or to the valves which control such supplies, either before or after the spout is mounted to the sink deck.

Before the clamp plate is secured to the spout waterway, the fastener 20 will first be located in the opening 50 as shown in FIG. 3. Thus, when the clamp plate and the spout waterway are permanently attached, the fastener will be held in the clamp plate by the cooperating flange and shoulder 68 and 64 to the end that the fastener will extend upwardly and is in position to receive the spout. Next, the escutcheon 26 will be positioned so that it extends over the clamp plate, as shown in FIG. 2. Both the underside of the clamp plate and the escutcheon will bear against the top of the sink deck. The spout is then positioned over both the spout waterway and the fastener, as shown in FIG. 2. The spout waterway extends into the boss 78 so as to provide a water connection for the spout discharge 76. At this point the lift rod 22 is not positioned within the spout, but instead, a tool with a hex-shaped end, for example an allen wrench, will extend down through the opening 88 in the top of the spout and will turn the fastener 20 which is threaded into the boss 84. As the fastener is turned by the allen wrench, the spout 24 will be snugged down upon the escutcheon which will be held by the spout onto the top of the sink deck. Once this assembly is complete, the allen wrench is removed and the lift rod is inserted to perform its normal function.

To remove the spout, without affecting the underlying water connections, the lift rod will be pulled upwardly, out of the spout, and an allen wrench will be inserted in the tool receiving opening 74 of the fastener 20. The allen wrench will be turned to loosen the connection between the fastener and the spout. This will permit the spout to be removed. Thus, the spout may be replaced with one of different configuration and/or finish without affecting the underlying water connections. This is particularly advantageous when one is remodeling a bathroom or when a contractor wishes to do an upgrade or change the faucet exterior appearance without purchasing and installing an entirely new plumbing fixture.

Although the present invention is described in connection with a "modular" lavatory faucet spout, the invention has a broader context. It is often the situation that if a portion of a plumbing fixture which has both decorative and functional purposes is to be removed and replaced with one having the same functional purpose, but a different decorative purpose, that all of the fixtures in a lavatory or bathroom will be similarly modified so that all of the fixtures within the bath suite will have a common decorative theme. Thus, each of the plumbing fixtures, and this could include the faucet, a shower assembly, a tub spout, a bidet, as well as other water control plumbing products, will have a decorative portion of such plumbing fixture, which decorative portion also has a functional purpose, replaced or modified at the same time. Thus, the "modular" concept applies not just to a single fixture, but to all fixtures within a bath suite.

Figures 9, 10, 11:
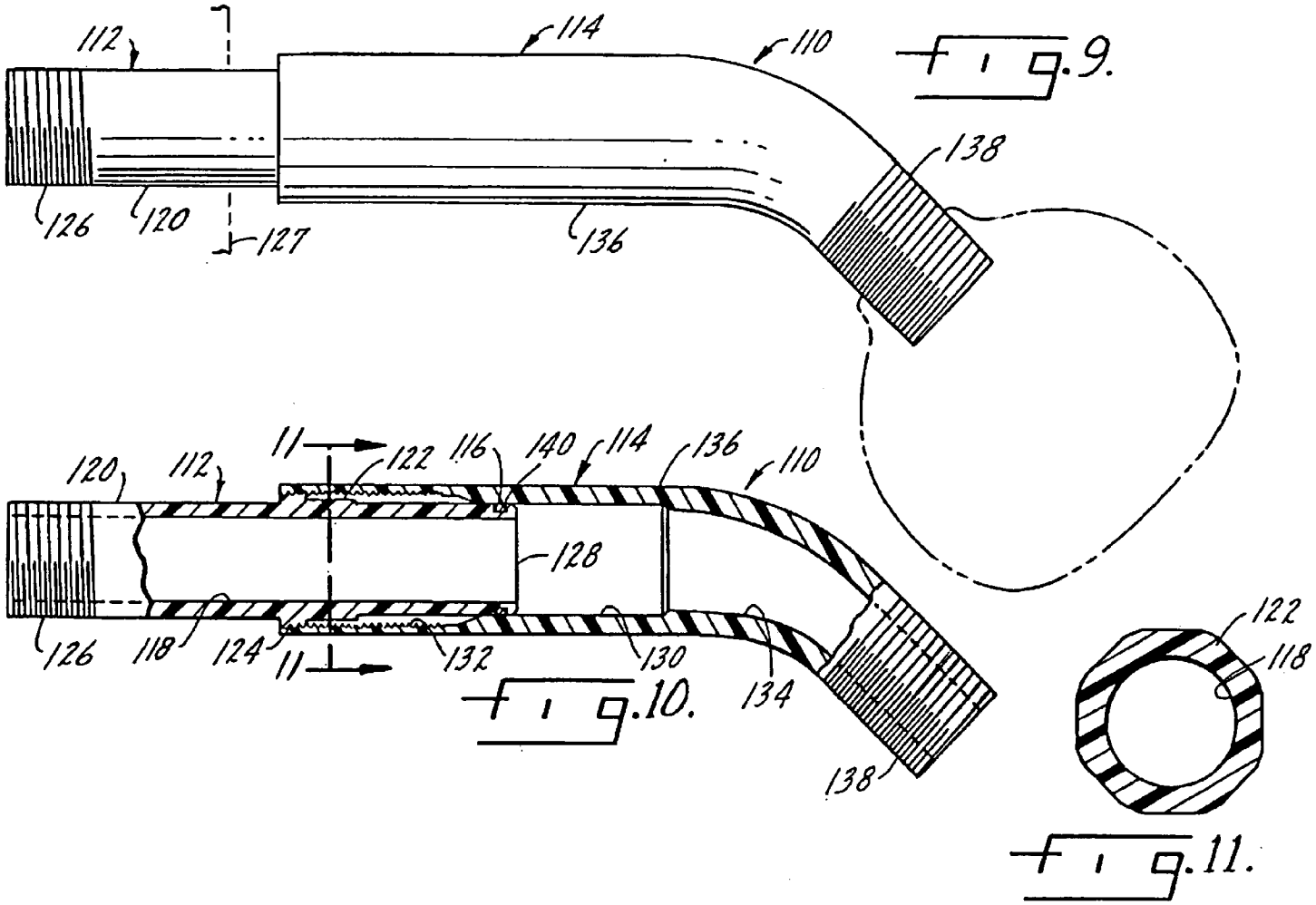
FIG. 9 is a side view of the shower arm mounting system with an attached shower head.
FIG. 10 is a partial vertical section of the mounting system shown in FIG. 9.
FIG. 11 is a section along plane 11—11 of FIG. 10.

In FIG. 9 and FIG. 10, the modular shower arm mounting system 110 includes a water conduit 112, a replaceable shower arm assembly 114 and an O-ring 116. The water conduit 112 has a generally uniform inner diameter 118 and an outer diameter 120 with a hexagonally shaped portion 122 adjacent a threaded area 124. The conduit 112 has one end 126 threadably attached to a manifold behind the shower wall 127 and an outlet end 128 projecting from the wall 127 a sufficient distance such that the hexagonally shaped portion 122 and threaded portion 124 are spaced away from the wall 127. The conduit 112 is connected to the manifold and thus provides a firm support for the visible elements of the shower assembly. FIG. 11 shows the hexagonally or polygonally shaped portion 122 which serves as a drive or tool engaging surface to allow the conduit 112 to be tightened to the manifold. The threaded area 124 provides for threaded engagement with the replaceable shower arm assembly 114.

It is preferred that all or a substantial portion of the conduit 112 which projects from the wall be located within the replaceable shower arm assembly 114 so that only the replaceable elements are visible. It is also preferred that the threaded portion 124 of the conduit be located adjacent the wall with the hexagonally shaped portion 122 being located adjacent and downstream thereof so that in assembly the replaceable shower arm assembly 114 passes over the hexagonally shaped portion 122 and threadably engages the threaded portion 124.

The replaceable shower arm assembly 114 has an inner wall 130 which has both a threaded portion 132 and a substantially smooth portion 134. The outer diameter 136 of the assembly 144 gradually decreases from adjacent the wall 127 toward an outwardly projecting end 138. The threaded portion 132 of the inner wall 130 is several times longer than the threaded portion 124 of the conduit 112 so that the shower arm assembly 114 may be continually tightened on the conduit 112 until the shower arm assembly is adjacent the wall with the shower arm assembly forming all or substantially all of the visible portion of the mounting system 110. The substantially smooth portion 134 of the inner wall 130 gradually decreases downstream of the threaded portion 132 as the inner wall approaches the outwardly projecting threaded end 138. A portion of the outwardly projecting end 138 may be angled down with respect to the rest of the shower arm assembly 114 so that projecting end is directed towards the user. As shown in FIG. 9, the projecting end 138 may threadably mount a shower head shown in phantom.

The O-ring 116 is adjacent the outlet end 128 of the conduit 112 and is positioned in an appropriately sized groove 140 to form a seal between the assembly 114 and the conduit 112. Because all or a substantial portion of the conduit 112 which projects beyond the wall is positioned within the replaceable shower arm assembly 114, a user desiring to change the appearance of the fixture need only replace the shower arm assembly 114. The assembly 114 is configured for easy and convenient removal so that the style and/or color of the shower arm may be conveniently changed by the user without the complication associated with behind the wall connections. The user merely threadably removes the old shower arm assembly without disconnecting the conduit from the manifold. Then the new shower arm assembly with the desired aesthetics and a similar threadable configuration to the old shower arm assembly is engaged with the conduit until the shower arm assembly is adjacent the wall. Thus, the visible portion of the modular shower arm mounting system may be replaced with any style that is desired by the user.

Whereas the preferred form of the invention has been shown and described herein, it should be realized that there may be many modifications, substitutions and alterations thereto.

The embodiments of the invention in which an exclusive property or privilege is claimed are defined as follows:

1. A plurality of independent and separate water control plumbing fixtures, each having a water control function different from another and each having a common decorative theme, each fixture for mounting on a support, which support has a normally visible surface and a normally non-visible surface, and wherein each fixture has water supply connections on the normally non-visible surface and has a functional and decorative element on the normally visible surface, and wherein the functional and decorative element of all such fixtures may be removed and replaced from the fixture from the visible surface without affecting the water supply connections on the normally non-visible surface, each fixture including a waterway attached to the water supply connections, each waterway including a portion extending beyond the visible surface and into its respective functional and decorative element to supply water thereto, the portion of the waterway extending beyond the visible surface being substantially concealed by the functional and decorative element, and fastening means mounted on each waterway on the visible surface, each fastening means including means for attaching and removing its respective functional and decorative element from only the visible surface of the support.

2. The plurality or water control plumbing fixtures of claim 1 wherein one of said functional and decorative elements is a sink faucet.

3. The plurality of water control plumbing fixtures of claim 1 wherein one of said functional and decorative elements is a shower arm.

4. A plurality of independent and separate water control plumbing fixtures, each having a water control function different from another and each having a common decorative theme, each fixture for mounting on a support, which support has a normally visible surface and a normally non-visible surface, and wherein each fixture has water supply connections on the normally non-visible surface and has a functional and decorative element on the normally visible surface, and wherein the functional and decorative element of all such fixtures may be removed and replaced from the fixture from the visible surface without affecting the water supply connections on the normally non-visible surface, each fixture including a waterway attached to the water supply connections, each waterway including a portion extending beyond the visible surface and into its respective functional and decorative element to supply water thereto, the portion of the waterway extending beyond the visible surface being substantially concealed by the functional and decorative element, and fastening means mounted on each waterway on the visible surface, each fastening means including means for attaching and removing its respective functional and decorative element from only the visible surface of the support;

wherein said waterway opens into a water passageway in said functional and decorative element and said waterway forms a circumferential seal between an outer side wall of said waterway and a portion of the functional and decorative element.

5. The plurality of water control plumbing fixtures of claim 4 wherein said seal includes one or more seal rings located in annular grooves in said outer side wall of said waterway.

6. A method of changing a bathroom decor comprising the steps of:

installing a plurality of modular plumbing fixtures, each modular plumbing fixture having decorative portions that have a first common decorative theme;

removing all decorative portions of said modular plumbing fixtures having said first common decorative theme without affecting underlying waterway connections; and replacing said removed decorative portions with new decorative portions having a second common decorative theme.

7. A plurality of discrete plumbing fixtures, all having a common decorative theme; each discrete plumbing fixture comprising:

at least one decorative element;

at least one functional element; and at least one combination element, wherein said at least one combination element has both decorative and functional purposes;

wherein each of said at least one decorative element and each of said at least one combination element is operable to be removed and replaced from above a normally visible surface without affecting underlying waterway connections.

* * * * *